US010137056B2

(12) United States Patent
Kotlov

(10) Patent No.: US 10,137,056 B2
(45) Date of Patent: Nov. 27, 2018

(54) DEVICE FOR SEXUAL STIMULATION

(71) Applicant: Stanislav Kotlov, Schiffweiler (DE)

(72) Inventor: Stanislav Kotlov, Schiffweiler (DE)

( * ) Notice: Subject to any disclaimer, the term of this patent is extended or adjusted under 35 U.S.C. 154(b) by 30 days.

(21) Appl. No.: 15/290,281

(22) Filed: Oct. 11, 2016

(65) Prior Publication Data

US 2017/0100303 A1 Apr. 13, 2017

(30) Foreign Application Priority Data

Oct. 9, 2015 (EP) ..... 15189137

(51) Int. Cl.
*A61H 21/00* (2006.01)
*A61H 19/00* (2006.01)
*A61H 23/00* (2006.01)

(52) U.S. Cl.
CPC ..... *A61H 19/44* (2013.01); *A61H 21/00* (2013.01); *A61H 23/00* (2013.01); *A61H 2201/0192* (2013.01)

(58) Field of Classification Search
CPC ..... A61H 19/44; A61H 21/00; A61H 2015/0042; A61H 2015/005; A61H 2201/1671
USPC ..... 600/38–41
See application file for complete search history.

(56) References Cited

U.S. PATENT DOCUMENTS 6,632,185 B2 * 10/2003 Chen ..... A61H 15/0085 600/38
7,438,681 B2 * 10/2008 Kobashikawa ..... A61H 19/34 600/38
7,559,886 B2 7/2009 Knyrim
8,647,255 B2 * 2/2014 Levy ..... A61F 5/41 600/38
2006/0047181 A1 * 3/2006 Hsu ..... A61H 15/0085 600/38
2013/0060081 A1 * 3/2013 Carter ..... A61H 19/44 600/38
2013/0197302 A1 * 8/2013 Levy ..... A61H 23/02 600/38
2016/0015596 A1 * 1/2016 Murison ..... A61H 23/0263 600/38

FOREIGN PATENT DOCUMENTS

AT 407481 B 3/2001
CN 201316392 Y 9/2009
DE 102008055869 A1 7/2010
DE 102009038448 A1 3/2011
(Continued)

*Primary Examiner* — Samuel Gilbert
(74) *Attorney, Agent, or Firm* — Lucas & Mercanti, LLP; Klaus P. Stoffel

(57) ABSTRACT

A device for sexual stimulation of the human body, the device including a phallus-shaped stimulation body. The thickness and/or the length of the stimulation body is variable in regions. The stimulation body has a preferably exchangeable stimulation element to permit the regional variation of the thickness, and the stimulation element is movable in the direction of the longitudinal axis of the stimulation body and/or in the circumferential direction of the stimulation body. The stimulation element expediently has at least one magnetic holding device, preferably a permanent magnet, and at least one magnetic carrier for the stimulation element is arranged movably inside the stimulation body.

19 Claims, 7 Drawing Sheets

(56) References Cited

FOREIGN PATENT DOCUMENTS

| | | | |
|---|---|---|---|
| DE | 102010018393 | A1 | 10/2011 |
| EP | 2856998 | A1 | 4/2015 |
| FR | 2942713 | A1 | 9/2010 |
| WO | 2005041845 | A1 | 5/2005 |
| WO | 2005084605 | A1 | 9/2005 |

* cited by examiner

DEVICE FOR SEXUAL STIMULATION

CROSS-REFERENCE TO RELATED APPLICATIONS

The present application claims priority of EP 15 189 137.1, filed Oct. 9, 2015, the priority of this application is hereby claimed and this application is incorporated herein by reference.

BACKGROUND OF THE INVENTION

The invention relates to a device for sexual stimulation of the human body, said device comprising a phallus-shaped stimulation body.

Such devices are known through use. A stimulating effect can be achieved through a vibration of the stimulation body.

SUMMARY OF THE INVENTION

The object of the present invention is to make available a device of the aforementioned type which permits better stimulation than the known devices.

According to the invention, the object is achieved by the fact that the thickness and/or the length of the stimulation body is variable in regions.

The device can advantageously generate a sexual stimulus that provides a particularly good simulation of stimulation by a male member. Additional manual movement of the stimulation body is not absolutely necessary.

In one embodiment of the invention, the stimulation body has a preferably exchangeable stimulation element to permit the regional variation of the thickness, which stimulation element is movable on a main body of the stimulation body, preferably in the direction of the longitudinal axis of the stimulation body and/or in the circumferential direction of the stimulation body, and forms a bulge on the main body.

A direction of movement and/or a speed of movement with which the stimulation element is movable on the main body in the direction of the longitudinal axis and/or in the circumferential direction can expediently be controlled, preferably independently of each other, and/or can be adjusted, preferably steplessly. The device can comprise different, exchangeable stimulation elements for various stimulation effects. The stimulation element is expediently provided in such a way that it bears against the outer face of the main body.

The stimulation body is expediently encased by a sheath which is preferably made of a flexible plastic, preferably latex and/or silicone. The sheath is preferably detachable from the device, so as to allow the stimulation element to be replaced by another stimulation element.

In one embodiment of the invention, the stimulation element has at least one magnetic holding means, preferably a permanent magnet, and at least one magnetic carrier for the stimulation element is arranged movably inside the stimulation body. The carrier is expediently movable parallel and/or transversely with respect to the longitudinal axis of the stimulation body and pulls the stimulation element with it when moved in the stimulation body. Advantageously, no direct mechanical connection has to be provided between the holding means and the abutment.

In the longitudinal direction of the stimulation body, the stimulation element expediently has a length corresponding to one thirtieth to one tenth of the total length of the stimulation body. Other lengths are also conceivable, but the stimulation element should not be more than half as long as the entire stimulation body.

In one embodiment of the invention, the stimulation element is ring-shaped, preferably as a ring completely enclosing the main body, which ring can be provided with an external diameter that is uniform or variable about its circumference. For example, an outer shape of the ring can have an undulating configuration or can have knobs in order to achieve an additional stimulating effect.

In a further embodiment of the invention, the stimulation element comprises individual segments which are arranged at a distance from one another, seen in the circumferential direction, and form a convexity, and which are preferably formed by ball segments.

At least one projection is expediently provided on a side of the stimulation element facing toward the main body, which projection engages in a guide groove formed on the outside of the main body, wherein the guide groove is preferably formed transversely with respect to the longitudinal axis of the main body, particularly preferably in a helical shape about the longitudinal axis of the main body, in order to permit a guided movement of the stimulation element along a trajectory formed by the guide groove. When the carrier entrains the stimulation element in its movement along the longitudinal axis inside the stimulation body, the fact that the projection is guided along the guide groove has the effect that the stimulation element is also moved transversely with respect to the longitudinal axis. By virtue of the magnetic holding force between the carrier and the stimulation element, it is not necessary also to move the carrier transversely with respect to the longitudinal axis in order to achieve a corresponding movement of the stimulation element.

In a further embodiment of the invention, the stimulation element comprises permanent magnets which are arranged on and/or in the sheath, and at least one magnetic repulsion element, with an opposite polarity to the permanent magnets, is arranged movably inside the stimulation body. When the repulsion element is moved close to the permanent magnets, the latter are repelled and, in this way, the sheath bulges. If a plurality of permanent magnets are arranged on or in the sheath, movement of the repulsion element in the direction of the longitudinal axis of the stimulation body can have the effect that a bulge generated by repulsion of the permanent magnets shifts with the movement of the repulsion element.

In one embodiment of the invention, a mechanism for moving the stimulation element is provided comprising a drive unit for a slide which is movable inside the stimulation body and on which the abutment or the repulsion element is arranged.

In a further embodiment, the stimulation body has a guide mechanism, preferably at least one guide rail, along which the slide is movable to and fro, wherein the guide mechanism is preferably arranged parallel, particularly preferably coaxial, to the longitudinal axis of the stimulation body.

Alternatively, the guide mechanism could be designed as a threaded rod along which the slide can move.

In a further embodiment of the invention, the stimulation body comprises a length adjustment element which is movable in order to lengthen or shorten the stimulation body in the axial direction in relation to a main body of the stimulation body. Preferably, the length adjustment element has a hollow cylinder which is mounted on and displaceable on the main body.

In one embodiment of the invention, a threaded spindle is provided for moving the length adjustment element. An inner face of the length adjustment element is preferably provided with a thread in which a pushing member engages that is rotated about the longitudinal axis of the main body by means of a drive and thus displaces the length adjustment element toward the main body.

In a preferred embodiment of the invention, the stimulation body is provided with permanent magnets to vary its length, the permanent magnets being able to be arranged in a starting position, in which they mutually attract, and in a lengthening position, in which they mutually repel. By arranging the permanent magnets in the respective position, the length adjustment element can be moved on the main body by movement of the permanent magnets between the starting position and the lengthening position.

At least one of the permanent magnets is expediently arranged on at least one telescopically lengthenable holding means, and one end of the holding means is connected to the main body, and the other end is connected to the length adjustment element.

For additional stimulation, the movable lengthening element could be provided with a vibration mechanism, by means of which it can be set in vibration. It will be appreciated that said sheath is designed to adapt to the changes in the length of the stimulation body. For this purpose, it can be flexible or partially foldable.

In a particular embodiment of the invention, the device is provided in such a way that the change in length and the change in thickness of the stimulation body can be controlled and/or adjusted, if appropriate separately.

In a further embodiment of the invention, the device can be controlled remotely. For this purpose, it is expediently provided with a receiver, preferably a radio receiver, e.g. for WLAN or Bluetooth, which interacts with a control unit for the device. The device can have its own dedicated remote control, although it would also be conceivable to provide the device in such a way that it is controllable by means of a cell phone or another computer, in particular also via a network. Provided for its control, the device can also comprise a computer program for the cell phone or for the computer.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
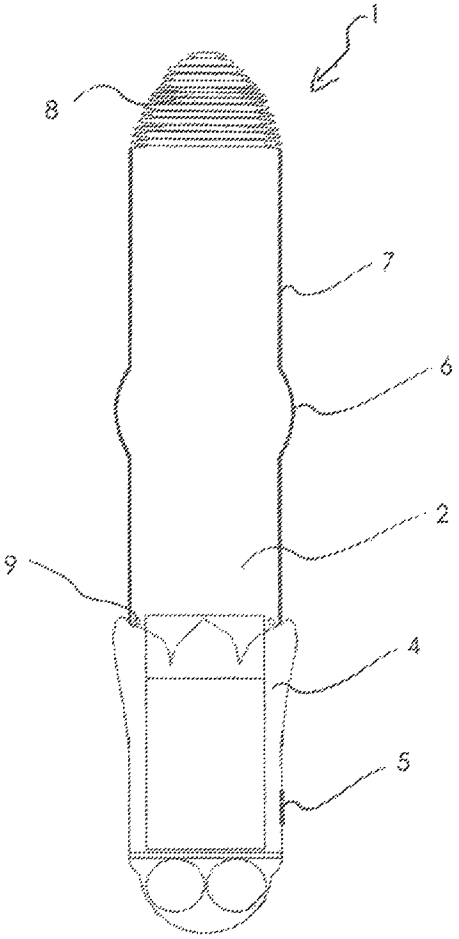
FIG. 1 shows a side view of a device according to the invention.

A device 1 shown in FIG. 1 comprises a phallus-shaped stimulation body 2, and a grip 4 with openings, each of the latter for engagement by a finger. Buttons 5 are arranged on the grip 4, with which buttons 5 the device 1 can be switched on and off and controlled.

Figure 2:
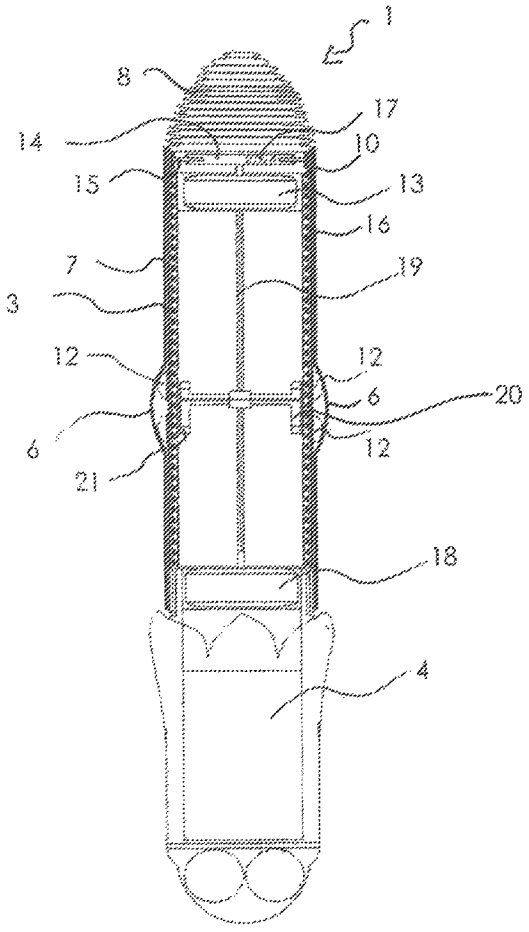
FIG. 2 shows a partial longitudinal section through the device according to FIG. 1.

The stimulation body 2 has a bulge 6, which is generated by knobs 12 shown in FIG. 2, which knobs 12 are arranged under a sheath 7 surrounding the stimulation body 2. In an upper part of the stimulation body 2, the sheath 7 comprises a folded-up portion 8, which is able to unfold when the stimulation body 2 is lengthened. At an end of the sheath 7 directed toward the grip 4, vents 9 are provided through which air is able to flow in or out during shortening of the lengthening of the stimulation body 2.

As FIG. 2 shows, the stimulation body 2 has a hollow cylinder 10 which can be pushed out of a main body 3 of the stimulation body 2. The main body 3 forms a portion of the outer surface of the stimulation body 2 along which the knobs 12, which can be formed e.g. by ball segments or the like, are movable. The stimulation body 2 can be lengthened or shortened by movement of the hollow cylinder 10. A drive rod 14 (shown in more detail in FIG. 3) is arranged in the stimulation body 2 and is rotatable about the longitudinal axis of the stimulation body 2 by means of a drive 13; rollers 15 are mounted on the ends of the drive rod 14 and engage in an inner thread 16 formed in the hollow cylinder 10. During rotation of the drive rod 14, the hollow cylinder 10 is moved out of or into the main body 3 depending on the direction of rotation. FIG. 4 shows the stimulation body 2 in a lengthened state, in which the portion 8 of the silicone sheath 7 is unfolded.

A weight 17 can be secured on the drive rod 14, at a distance from the rotation axis, and causes an imbalance during the rotation of the drive rod. In this way, the device 1 vibrates during the change in length of the stimulation body 2.

An electrical drive 18 shown in FIG. 2 is provided for rotating a threaded rod 19 which is arranged coaxially with respect to the longitudinal axis of the stimulation body 2 and which is connected rotatably at its upper end to the stimulation body 2. A slide 20, which is connected to the threaded rod 19 by means of a nut and on which magnets 21 are mounted, can move along the threaded rod 19. The magnets 21 form magnetic abutments for magnets (not shown here) which are arranged on the knobs 12 and are attracted by the magnets 21.

During a movement of the slide 20 along the threaded rod 19, the magnets 21 entrain the knobs 12, such that the knobs 12 are moved in the longitudinal direction of the stimulation body 2 along the outside of the stimulation body 2.

Reference is now made to FIGS. 5 to 16, where identical parts or parts with identical functions are designated by the same reference numbers as in FIGS. 1 and 2, with each reference number having a letter added thereto.

Figure 3:
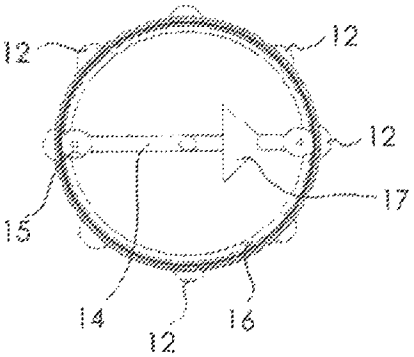
FIG. 3 shows a cross section through the stimulation body according to FIG. 1.
Figure 4:
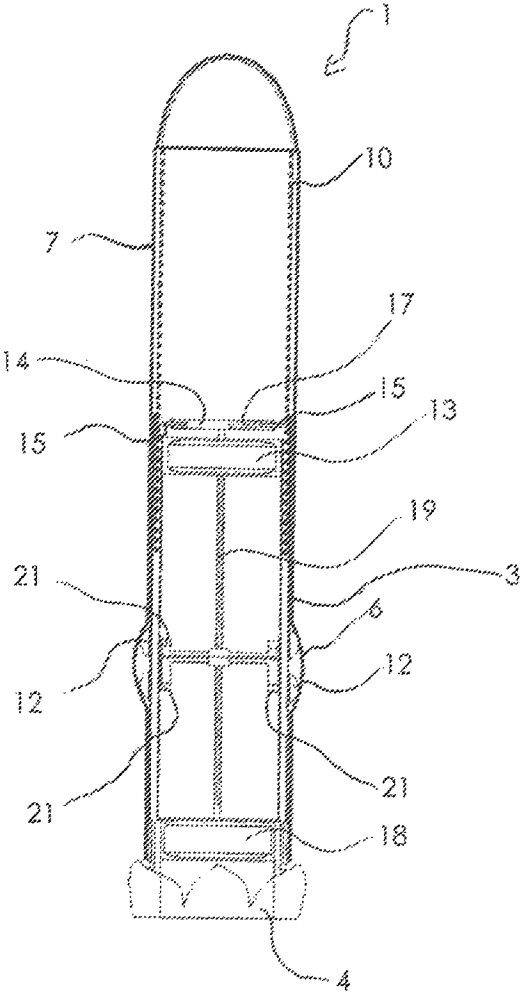
FIG. 4 shows a partial longitudinal section through the device according to FIG. 1 in another position.
Figure 5:
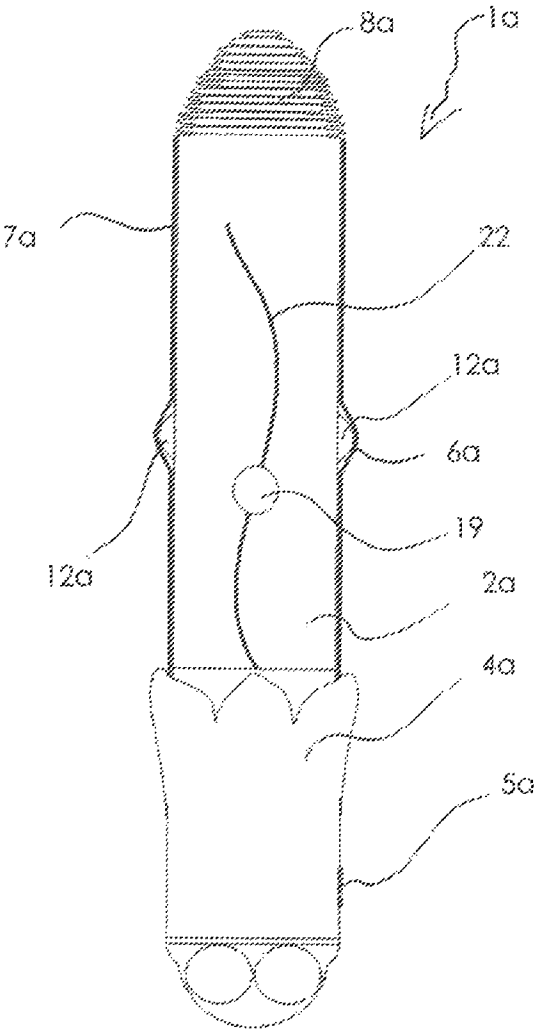
FIG. 5 shows a further device according to the invention.

A further device 1*a*, shown in FIG. 5, differs from the device according to FIGS. 1 to 4 in that four grooves 22 are formed on an outer face of a stimulation body 2*a*, which grooves 22 extend in the longitudinal direction of the stimulation element 2*a* and have a curved shape. In each of the grooves 22 sits a knob 12*a* which, on its side facing toward the stimulation body 2*a*, is provided with a projection (not shown here) that engages in the groove 22. When magnets 21*a* (not shown here) are moved inside the stimulation body 2*a* by means of the drive described with reference to FIGS. 1 to 4, the magnets 21*a* entrain the knobs 12*a* on account of magnetic forces of attraction, wherein the knobs 12*a* are entrained along the groove 22 and are thus moved not only in the longitudinal direction of the stimulation body 2*a* but also transversely thereto.

Figure 6:
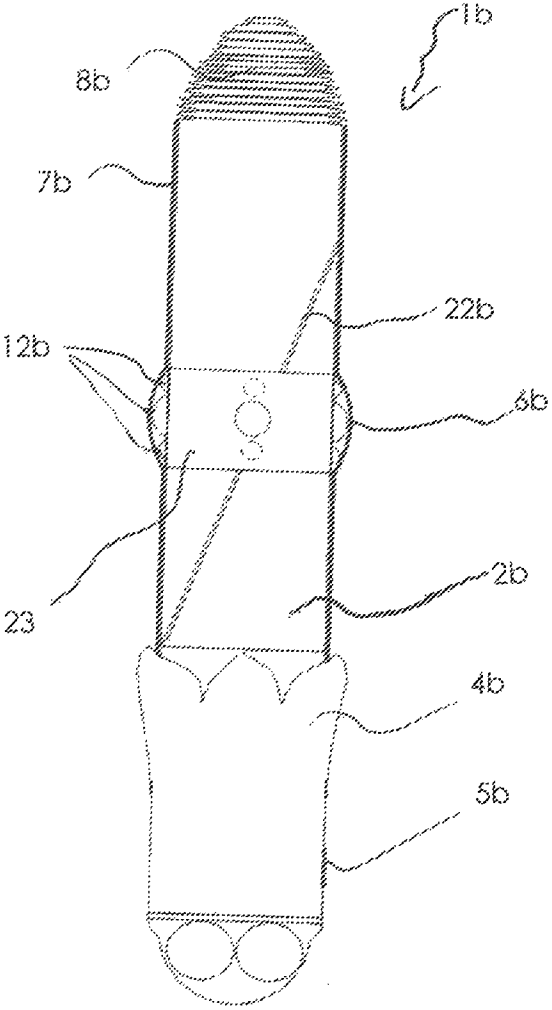
FIG. 6 shows a further device according to the invention.

In a further device 1*b* according to the invention, shown in FIG. 6, a ring 23 is arranged on a stimulation body 2*b*, and groups of in each case three knobs 12*b* are formed, spaced apart from each other in the circumferential direction, on the outer face of said ring 23. A groove 22*b* arranged transversely with respect to the longitudinal axis of the stimulation body 2*b* is formed on an outer face of the stimulation body 2*b*, in which groove 22*b* the ring 23 engages via a projection (not shown here) formed on its inner face. When magnets 21*b* (not shown here) arranged inside the stimulation body 2*b* are moved by means of the drive described with reference to FIGS. 2 to 4, the ring 23 is entrained along the groove 22*b*, such that the knobs 12*b* execute a helical movement.

Figure 7:
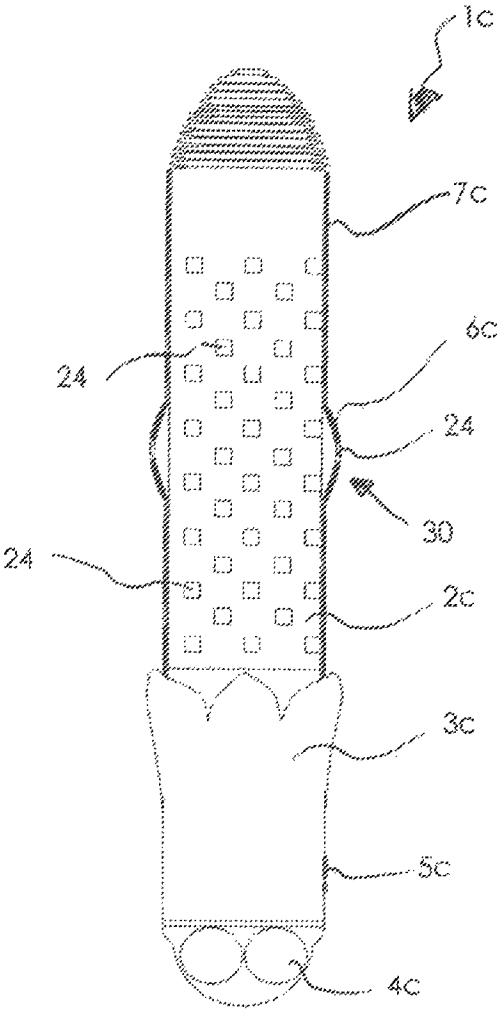
FIG. 7 shows a further device according to the invention.

FIG. 7 shows a further device is according to the invention, which differs from the devices according to FIGS. 1 to 6 in that a bulge 6*c* is formed on an outer face of a stimulation body 2*c* by an air cushion 30 which develops, in a manner explained below, between the stimulation body 2*c* and a sheath 7*c*. A plurality of flat permanent magnets 24, arranged at a distance from one another and uniformly distributed, are placed in the sheath 7*c*. When a magnet 21*c* with an opposite polarity to the permanent magnets 24 is moved inside the stimulation body 2*c*, in the manner explained with reference to FIGS. 1 to 4, the permanent magnets 24 are repelled and cause the sheath 7*c* to bulge. The bulge 6*c* accordingly moves along with the magnet 21*c*.

Figure 8:
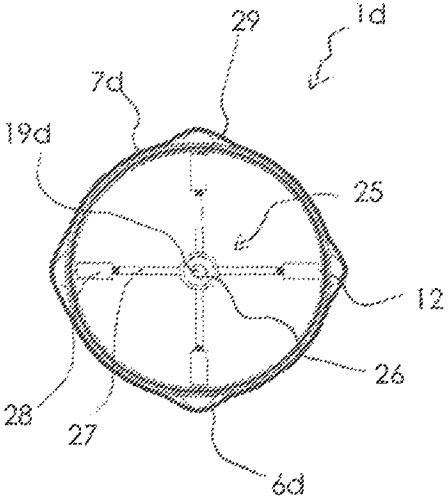
FIG. 8 shows a cross section through a stimulation body of a further device according to the invention.

FIG. 8 shows a cross section through a stimulation body 2*d* with a drive mechanism 25 of a further device 1*d* according to the invention, said further device 1*d* having a threaded rod 19*d* which is arranged in the longitudinal direction of the stimulation body 2*d* and is rotatable by means of a drive 18 shown in FIG. 2 and on which a double nut 26 is arranged movably. Link elements 27 are rigidly connected to the double nut 26 and, at their ends facing toward the inner face of the stimulation body 2*d*, carry magnets 28 which engage with a projection 29 in a thread provided on the inner face of the stimulation body 2*d*. During the rotation of the threaded rod 19*d*, the double nut 26 moves along the threaded rod 19*d* and thus rotates about a rotation axis coaxial to the threaded rod 19*d*. Knobs 12*d* provided with magnets, and bearing against the outer face of the stimulation body 2*d* under a silicone sheath 7*d* at a position where the magnets 28 are located on the inner face, are attracted by the magnets 28 and are entrained in a helical movement about the longitudinal axis of the stimulation body 2*d*, on the outer face of the latter.

Instead of engaging in the thread, the projection 29 could also engage in a groove (not shown here) introduced into the inner face of the stimulation body 2*d* and preferably extending transversely with respect to the longitudinal direction of the stimulation body 2*d*, such that the distance by which the knobs 12*d* are moved depends on the profile of the groove. It will be appreciated that the groove could be formed in a helical shape, as explained above with reference to FIGS. 5 and 6, or could have a curved shape.

It will be appreciated that, instead of the four link elements 27, a smaller or larger number of link elements could also be provided.

Figure 9:
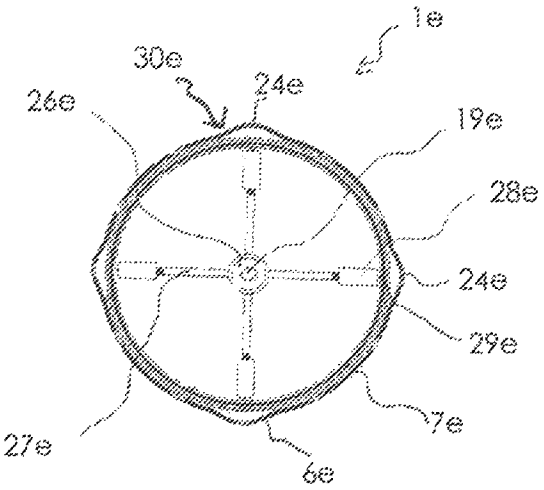
FIG. 9 shows a cross section through a stimulation body of a further device according to the invention.

FIG. 9 shows a cross section through a stimulation body 2*e* of a further device 1*e* according to the invention, which differs from the device shown in FIG. 8 in that a local bulging 6*e* of a sheath 7*e* is formed by an air cushion 30*e* between the stimulation body 2*e* and a sheath 7*e*. As has been explained above with reference to FIG. 7, the air cushion 30*e* forms as a result of magnetic repulsion forces between permanent magnets 24*e*, which are arranged in the sheath 7*e*, and magnets 28*e*, which are provided in the inside of the stimulation body 2*e*.

Figure 11:
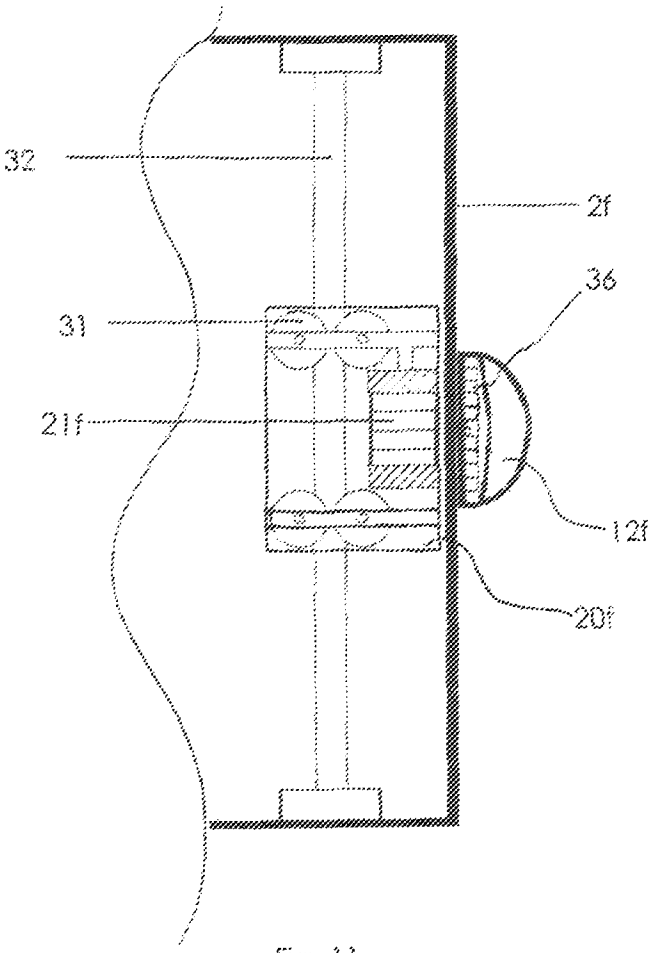
FIG. 11 shows a detail of the device according to FIG. 10.
Figure 10:
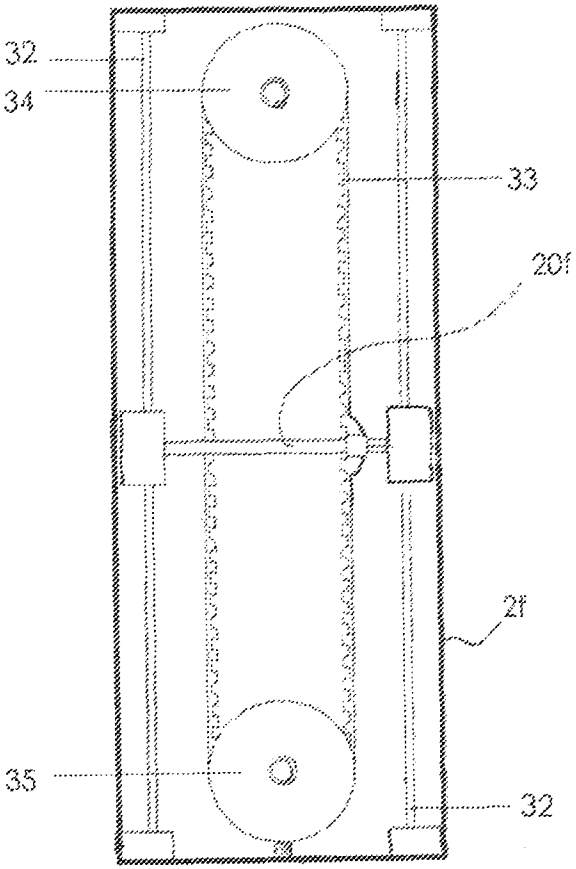
FIG. 10 shows a part of a further device according to the invention.

FIGS. 10 and 11 show, in a further illustrative embodiment, a possible way of moving magnets 21*f* in the interior of a stimulation body 2*f* of a further device 1*f* according to the invention, in order to move knobs 12*f*, or magnets arranged in a sheath, so as to create an air cushion. The magnets 21*f* are secured on a slide 20*f* which, as is shown in more detail in FIG. 11, has four wheels 31 that are able to run along a rod 32 during movement of the slide 20*f*. The slide 20*f* is moreover connected to a toothed belt 33, which is guided over two toothed wheels 34, 35. When the toothed wheel 34 is set in rotation by means of a drive (not shown here), the toothed belt 33 is moved together with the slide 20*f*. In the process, the magnet 21*f* entrains a knob 12*f* likewise provided with a magnet 36, as has been explained above.

The drive mechanism described with reference to FIGS. 10 and 11 is also suitable in particular for stimulation bodies which, in contrast to the stimulation bodies shown in the figures, could have a curved shape.

FIGS. 12 to 15 show a further mechanism for changing the length of a stimulation body 2*g*. The interior of a main body 3*g* of the stimulation body 2*g* accommodates a mechanism for moving a hollow cylinder 10*g*. The mechanism has an extendable central telescopic rod 37 arranged coaxially with respect to the longitudinal axis of the stimulation body 2*g*, which telescopic rod 37 is mounted rotatably about its longitudinal axis and can be rotated by means of a drive 13*g* that has a gear 38. Four slides 39, arranged at a distance from one another on the telescopic rod 37, have a bar element 40 (shown in FIG. 13), on the ends of which magnets 41 are mounted. Magnets 41 adjacent in the longitudinal direction of the stimulation body 2*g* mutually attract and are kept at a distance from each other by spacers 42 shown in FIG. 15.

Parallel to the longitudinal axis of the stimulation body 2*g*, two extendable rails 43 are provided on which five slides 44 are arranged, with magnets 45 secured on the slides 44. Directly adjacent magnets 45 mutually attract and are kept at a distance from each other by spacers 42. The two rails 43 are rigidly connected to each other via a web 47 (shown in FIG. 13).

The following explains how the length of the stimulation body 2*g* can be adjusted.

Figure 13:
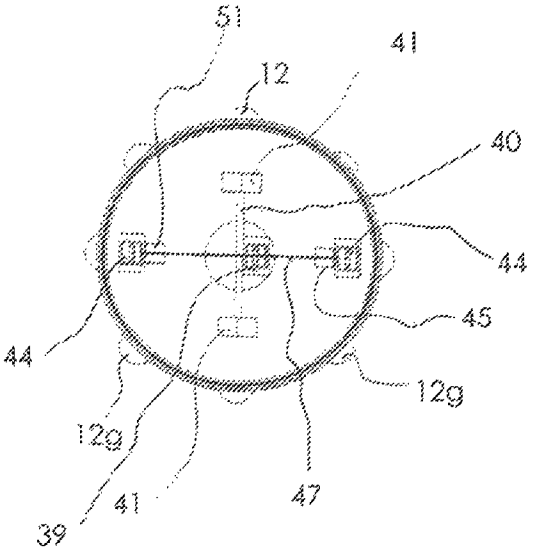
FIGS. 13 and 14 show the device according to FIG. 12 in different positions in cross section.

In the unlengthened state (FIG. 12), the bar element 40 with the magnets 41 arranged at its ends, is arranged in the starting position shown in FIG. 13.

Figure 15:
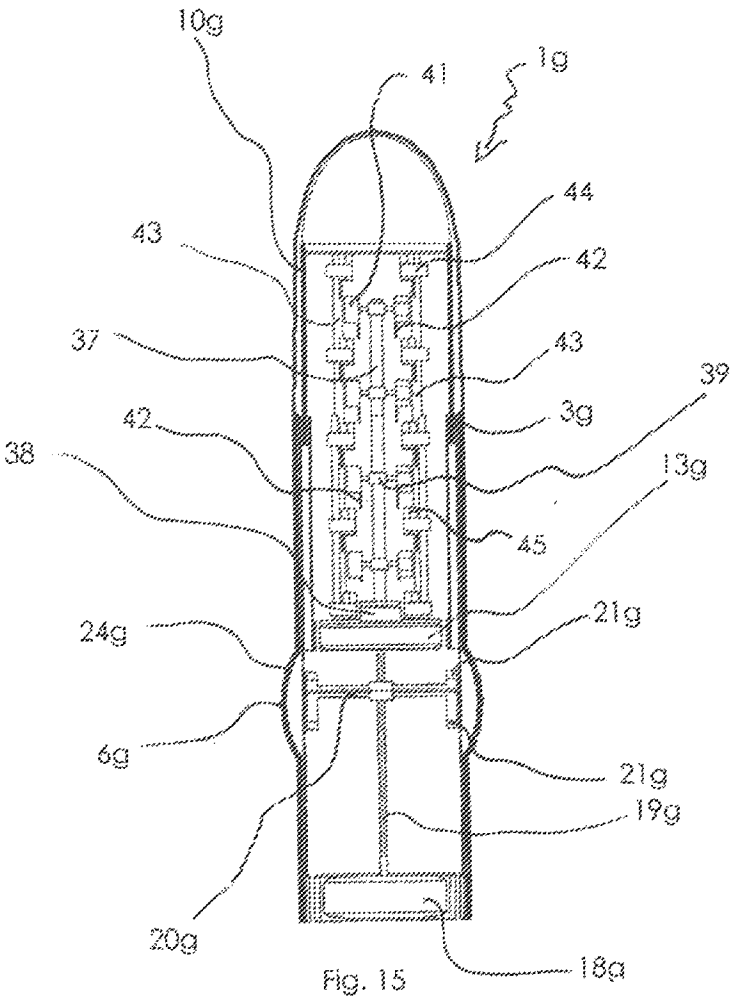
FIG. 15 shows the device according to FIG. 12 in another position in longitudinal section.
Figure 12:
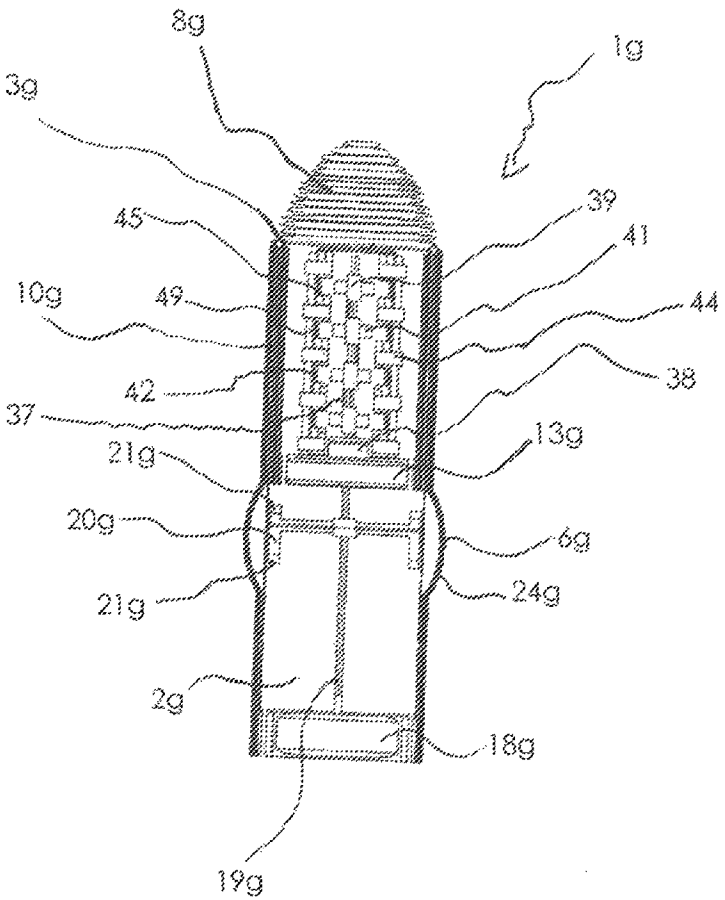
FIG. 12 shows a further device according to the invention in a longitudinal section.
Figure 16:
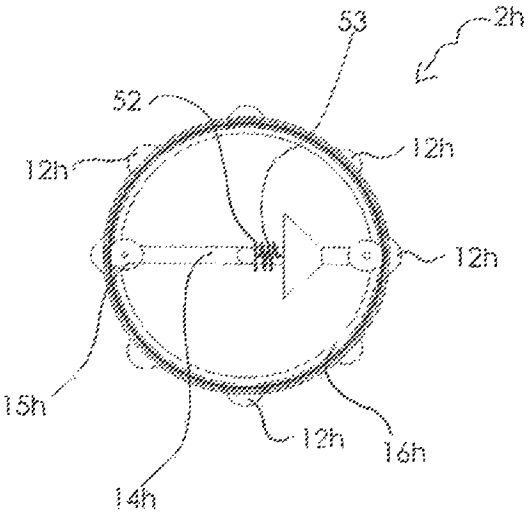
FIG. 16 shows a further device according to the invention in cross section.
Figure 14:
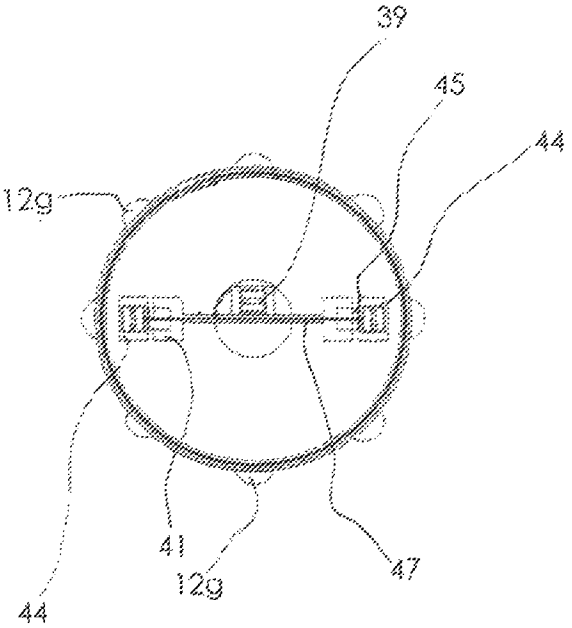

In order to lengthen the stimulation body 2*g*, the telescopic rod 37 is rotated 90° about its longitudinal axis, such that the magnets 41, as shown in FIG. 14, each slide between the magnets 45 of two adjacent slides 44. Since the magnets 41 and 45 on mutually facing portions have opposite polarities, the magnets 41, 45 are mutually repelled. In this way, the hollow cylinder 10*g* is moved out from the main body 3*g* and the stimulation body 2*g* is lengthened. FIG. 15 shows the stimulation element 2*g* in the extended state with a corresponding arrangement of the magnets 41, 45.

In order to shorten the stimulation body 2*g* again, the telescopic rod 37 is returned from the end position shown in FIG. 14 to the starting position shown in FIG. 13. After the rotation of the telescopic rod 37, the slides 44 are moved back toward each other by forces of attraction acting between adjacent magnets 41, 45, and the outer guide rails 43 are pushed back again into the position shown in FIG. 12.

It will be appreciated that, by alternating the rotation of the telescopic rod 37, it is possible to obtain an alternating and optionally oscillating lengthening and shortening of the stimulation body 2*g*.

A rotatable drive rod 14*h* (shown in FIG. 16) of a further device according to the invention differs from the one according to FIG. 3 in that a weight 17*h* is arranged movably in the longitudinal direction of the drive rod 14*h*. A spring 53 is connected at one end to the weight 17*h* and at its other end to a spring retainer 52 of the drive rod 14*h*. The higher the speed at which the drive rod 14*h* rotates, the greater a centrifugal force which acts on the weight 17*h* and which causes a movement of the weight 17*h* counter to a spring force of the spring 53. The farther the weight 17*h* is moved away from the longitudinal axis of a stimulation body 2*h* about which the drive rod 14*h* is rotated, the greater an imbalance that acts on the device and that results in a vibration of the stimulation body.

For the various devices 1, 1*a*, 1*b*, 1*c*, 1*d*, 1*e*, 1*f*, 1*g* described above, the movements of the respective stimulation bodies 2, 2*a*, 2*b*, 2*c*, 2*d*, 2*e*, 2*f*, 2*g*, 2*h* and of the respective hollow cylinders 10, 10*a*, 10*b*, 10*c*, 10*d*, 10*e*, 10*f*, 10*g* can be controlled independently of each other.

The control can be effected through actuation of the buttons 5, 5*a*. Alternatively, the devices could also be provided with a radio receiver, such that they can be controlled remotely. Such remote control could be obtained using a remote control unit specially provided for the device. However, it would also be conceivable for the devices to be controlled by means of a computer or a smartphone, if appropriate by WLAN or Bluetooth, and/or via a computer network. It is moreover possible that the respective movement speeds can be regulated and/or controlled by a user actuating the buttons 5, 5*a* independently of each other.

It will be appreciated that, in contrast to the devices explained above, the stimulation bodies could also have a curved shape.

It would also be conceivable to provide a device according to the invention that has two or more of the stimulation bodies.

While specific embodiments of the invention have been shown and described in detail to illustrate the inventive principles, it will be understood that the invention may be embodied otherwise without departing from such principles.

I claim:

1. A device for sexual stimulation of a human body, said device comprising a phallus-shaped stimulation body having a thickness and/or a length that is variable in regions, wherein the stimulation body comprises a length adjustment element that is movable to lengthen and shorten the stimulation body in an axial direction in relation to a main body of the stimulation body, and has a hollow cylinder that is mounted on and displaceable on the main body, wherein the stimulation body is provided with permanent magnets to vary the length of the stimulation body, the permanent magnets being arrangeable in a starting position, in which the permanent magnets mutually attract, and in a lengthening position, in which the permanent magnets mutually repel, and the length adjustment element is movable on the main body by movement of the permanent magnets between the starting position and the lengthening position.

2. The device according to claim 1, wherein the stimulation body has an exchangeable stimulation element to provide a regional variation of the thickness.

3. The device according to claim 2, wherein the stimulation element is movable in a direction of a longitudinal axis of the stimulation body and/or in a circumferential direction of the stimulation body.

4. The device according to claim 2, wherein the stimulation element is arranged on a main body of the stimulation body and forms a bulge on the main body.

5. The device according to claim 4, wherein the stimulation element comprises magnets which are arranged on or in a sheath surrounding the main body, at least one magnetic repulsion element being arranged movably inside the main body.

6. The device according to claim 1, wherein at least one of the permanent magnets is arranged on at least one telescopically lengthenable holder, one end of the holder being connected to the main body, and another end of the holder being connected to the length adjustment element.

7. The device according to claim 2, wherein the stimulation element is ring-shaped and completely encloses a main body of the stimulation body.

8. The device according to claim 2, wherein the stimulation element has individual segments arranged at a distance from one another in a circumferential direction to form a bulge.

9. The device according to claim 8, wherein the individual segments are ball segments.

10. The device according to claim 2, wherein at least one projection is provided on a side of the stimulation element facing toward a main body of the stimulation body, which projection engages in a guide groove formed on an outside of the main body.

11. The device according to claim 10, wherein the guide groove is formed transversely with respect to a longitudinal axis of the main body.

12. The device according to claim 10, wherein the guide groove is formed in a helical shape about a longitudinal axis of the main body.

13. The device according to claim 10, wherein at least one magnetic abutment or at least one magnetic repulsion element is arranged on the slide.

14. The device according to claim 2, further comprising at least one slide movable inside the stimulation body in order to move the stimulation element.

15. The device according to claim 14, wherein the stimulation body has a guide along which the slide is movable, wherein the guide is arranged parallel to a longitudinal axis of the stimulation body.

16. The device according to claim 15, wherein the guide is a guide rail or a threaded rod coaxial to the longitudinal axis of the stimulation body.

17. The device according to claim 2, wherein the stimulation element has at least one magnetic holding device, and at least one magnetic carrier for the stimulation element is arranged movably inside the stimulation body.

18. The device according to claim 17, wherein the magnetic holding device is a permanent magnet.

19. A device for sexual stimulation of a human body, said device comprising a phallus-shaped stimulation body having a thickness and/or a length that is variable in regions, wherein the stimulation body comprises a length adjustment element that is movable to lengthen and shorten the stimulation body in an axial direction in relation to a main body of the stimulation body, wherein the stimulation body is provided with permanent magnets to vary the length of the stimulation body, the permanent magnets being arrangeable in a starting position, in which the permanent magnets mutually attract, and in a lengthening position, in which the permanent magnets mutually repel, and the length adjustment element is movable on the main body by movement of the permanent magnets between the starting position and the lengthening position.

* * * * *